US005408804A

United States Patent [19]

Schröder

[11] Patent Number: 5,408,804

[45] Date of Patent: Apr. 25, 1995

[54] METHOD AND APPARATUS FOR FILLING AND CLOSING A TWO-CHAMBER PLASTIC CONTAINER

[75] Inventor: Klaus Schröder, Ahaus, Germany

[73] Assignee: GEA Finnah GmbH, Ahaus, Germany

[21] Appl. No.: 192,467

[22] Filed: Feb. 7, 1994

[30] Foreign Application Priority Data

Feb. 13, 1993 [DE] Germany ..... 43 04 337.2

[51] Int. Cl.[6] ..... B65B 3/02; B65B 43/00

[52] U.S. Cl. ..... 53/452; 53/246; 53/240

[58] Field of Search ..... 53/452, 559, 167, 240, 53/381.1, 382.2, 282, 453, 474, 238, 246, 381.7, 467, 473, 539

[56] References Cited

U.S. PATENT DOCUMENTS

| | | | |
|---|---|---|---|
| 4,655,026 | 4/1987 | Wigoda | 53/238 |
| 4,684,025 | 8/1987 | Copland et al. | 53/453 |
| 4,819,412 | 4/1989 | Sengewald | 53/282 |

*Primary Examiner*—Lowell A. Larson
*Assistant Examiner*—Rodney A. Butler
*Attorney, Agent, or Firm*—Jordan and Hamburg

[57] ABSTRACT

A method for filling and closing off a two-chamber container with different filling materials includes two sealing steps for the closing-off procedure, the first chamber being filled with the first material under sterile conditions and closed off over a first partial seal with a covering sheet, after which the second chamber is filled with the second material and closed off by means of a second partial seal with formation of a fully sealed two-chamber container.

10 Claims, 6 Drawing Sheets

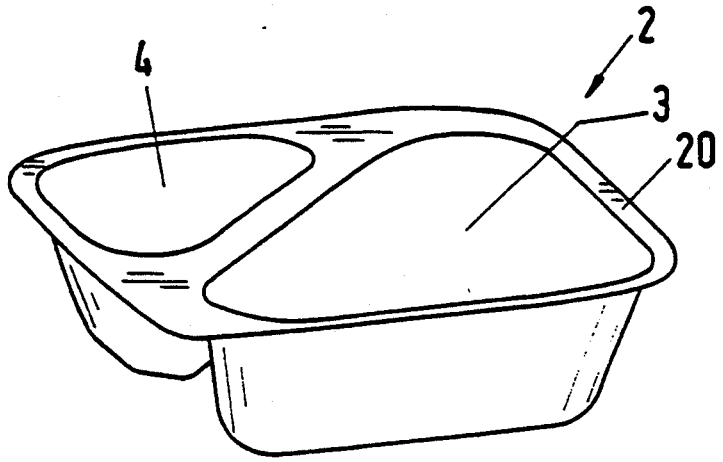
Fig.5
Fig.6
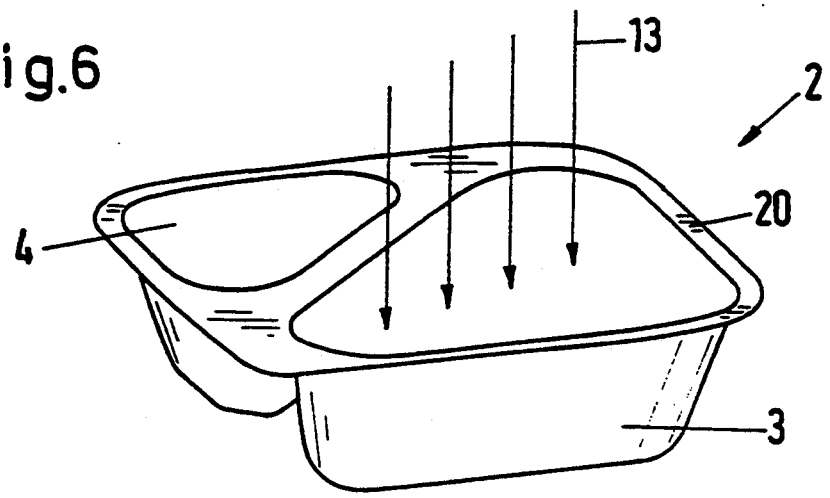
Fig.7
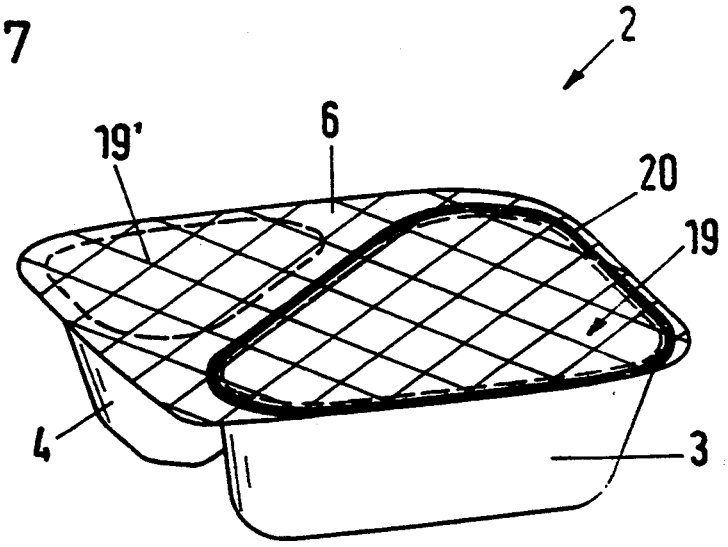

METHOD AND APPARATUS FOR FILLING AND CLOSING A TWO-CHAMBER PLASTIC CONTAINER

BACKGROUND OF THE INVENTION

This invention relates to a method and an apparatus for filling and closing a two-chamber container.

In the case of a known, two-chamber container of DE 37 18 225 C1, the chambers, which are to be filled with different materials, are provided with an intermediate sheet in each case covering the chamber that is filled first, the second chamber being filled without affecting the sterility of the material filled into the first chamber and, after that, the two-chamber container is closed off as a whole with a covering sheet so that the expense of manufacturing such a two-chamber container with an interim sheet can be increased and, due to additional material differences, recycling can be adversely affected.

SUMMARY OF THE INVENTION

This invention is concerned with the problem of providing a method and an apparatus which make it possible, at reduced cost, to fill the second chamber of the container without affecting the sterility of the aseptically filled first chamber.

For covering the first chamber of the two-chamber container that is filled with the first material under aseptic. conditions and the subsequently filled second chamber, the inventive method makes it possible to provide in each case a uniform, preferably one-piece covering sheet material, so that, after a continuous process with, in each case, only partial sealing in the region of the two chambers, the filled two-chamber container is supplied with a full seal. With this, the filling with materials, which do not affect one another, can be achieved without an additional sheet supplying system, which increases the production and operating costs and the expense, necessary for packing the two-chamber container under sterile conditions, can be limited to a few operating phases.

With the apparatus developed pursuant to the invention, the two-chamber container, formed from the unrolling container sheet, can be covered completely with the covering sheet after the chambers are formed and the first chamber is filled, since the downstream severing station advantageously enables the two-chamber container and the cover-conforming covering sheet to be separated. In this forward feed phase, only one chamber is filled and closed off tightly by means of the first partial seal, so that thereafter the second chamber can be filled and covered also outside of the sterile region with little technical effort.

In an appropriate embodiment, the covering sheet is brought into supporting engagement over the two chambers of the two-chamber container in the region of the sterile tunnel, so that the edge of the container as well as the covering sheet, which up to this region is supported and already sealed on over the first chamber, can be cut out on the downstream severing station without any shifting and so as to follow the contour. The apparatus furthermore is provided with component parts, which enable the unsealed regions of the covering sheet to be lifted subsequently, so that the covering sheet material, utilizing its elasticity, can advantageously be tilted with little effort in the region of a sealed edge formed by the first partial sealing, so that the second chamber is freely accessible and the filling of the chamber is attainable without additional aids.

With the one-piece covering sheet, the two-chamber container, constructed pursuant to the invention, has a chamber covering, which is provided in the region between the two chambers on a connecting part with separate sealing seams, which run parallel to one another here, advantageously can be formed independently of one another and makes possible the easier handling of the two-chamber container when used as intended, so that the covering sheet is sufficiently tight during transport and also completely removable, with little effort, during the opening motion.

Further details and advantages arise out of the following description and the accompanying drawing, which illustrates diagrammatically an embodiment of an inventive apparatus for carrying out the method and an inventive two-chamber container.

BRIEF DESCRIPTION OF THE DRAWINGS

FIGS. 5 and 6 each are perspective views representing the filling of a first chamber of the two-chamber container;

FIGS. 7 and 8 each are perspective views representing a partial seal of the two-chamber container, provided with a one-piece covering sheet, and its stamping out and separation;

DESCRIPTION OF THE PREFERRED EMBODIMENTS

Figure 1:
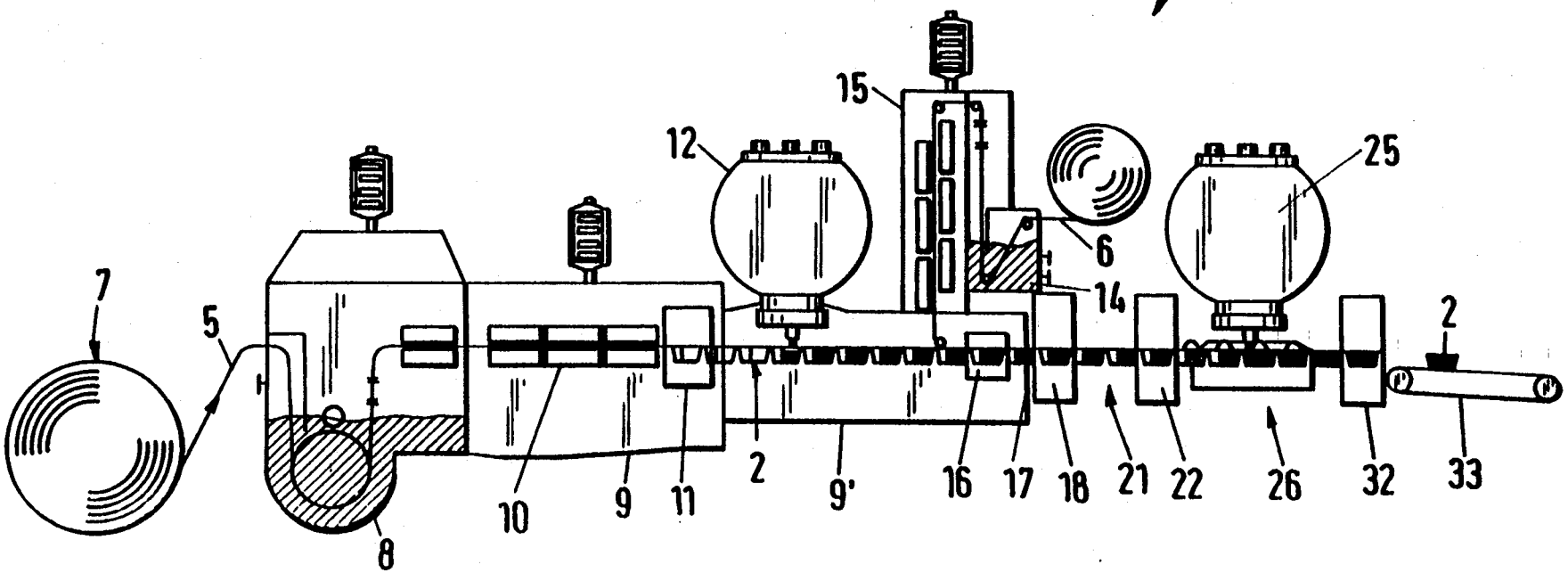
FIG. 1 is a diagrammatic side view of an inventive apparatus for filling and closing a two-chamber container.

FIG. 1 shows an apparatus for filling and closing a two-chamber container 2 such as shown in FIG. 5. The apparatus is labeled 1 as a whole and can be filled with different materials in the area of its chamber 3, 4. In the most appropriate embodiment, the apparatus 1 is constructed as a processing unit forming the two-chamber container 2 from a continuously supplied bottom sheet 5 and a covering from a continuously supplied covering sheet 6. Starting out from a bottom sheet unrolling device 7, the bottom sheet 5 is passed through a dipping bath 8 into a sterile tunnel 9, in which container-shaping equipment 11 is provided after a contact heater 10. Under the action of an appropriate molding tool (not shown), the chambers 3, 4, in each case forming the two-chamber container 2 in pairs, are formed in the bottom sheet 5. After that, the bottom sheet is moved into a second section of the sterile tunnel 9'. The first chamber 3 of the two-chamber container 2 is filled here in the direction of arrow 13 (FIG. 6) using a metering part 12.

In the second region of the sterile tunnel 9', the covering sheet 6 is supplied after the metering part 12. After passing through a dip bath 14 and a group of hot plates 15, which evaporate residual liquid film, the covering sheet 6 is introduced into the tunnel region 9' and connected with the container sheet 5 in a connecting apparatus 16 over a seal (not shown) along the side edges.

Immediately at the outlet 17 of the sterile tunnel 9 or 9', the latter discharges into a sealing station 18, which accommodates the composite of molded container sheet 5 and covering sheet 6 and in which a covering sheet area 19 (FIG. 7), which is above the filled chamber 3, is sealed on in the region of its sealing edge 20. With this, the two-chamber container 2 is provided with a first partial seal and, at the same time, covered with the covering sheet in the area of the unsealed chamber 4, so that the two-chamber container 2, still in a sheet composite, can be advanced into an unsterile region 21 of the apparatus 1 without affecting the sterility in the area of chamber 4.

Figure 8:
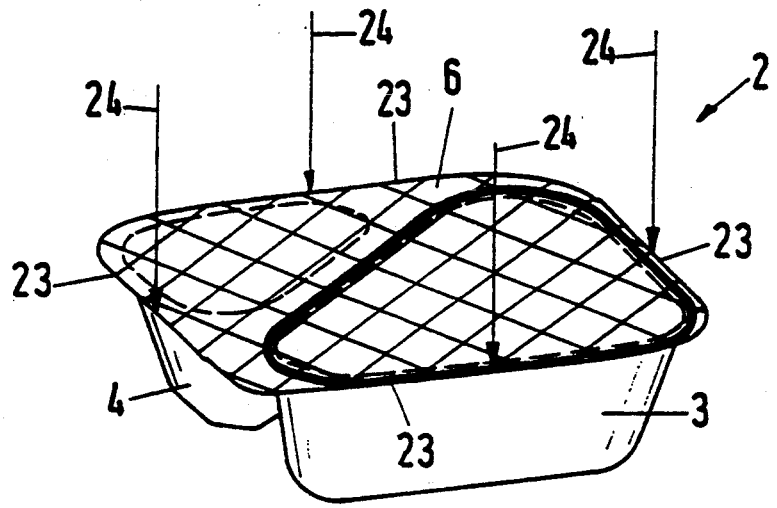

In an advantageous development of the inventive apparatus 1, the two-chamber container 2 is now detached from the bottom sheet composite in the region of a severing station 22, the container and the covering sheet 6 being severed jointly and in conformity with a covering in the edge region 23 by means of the severing station 22, which is formed by a cutting press, from the respective sheet (FIG. 8). For this purpose, severing forces are initiated by means of a severing tool (not shown) in the direction of arrows 24 in such a way, that a positional displacement of the covering sheet 6 over the chambers 3, 4 is reliably avoided and the covering sheet is placed down largely without folds.

With this, individual containers 2, with a partially sealed covering sheet 6 (FIG. 7) are made available at the outlet of the severing station 22 and conveyed further for filling the second chamber 4 in the region of a second metering device 25.

Figure 2:
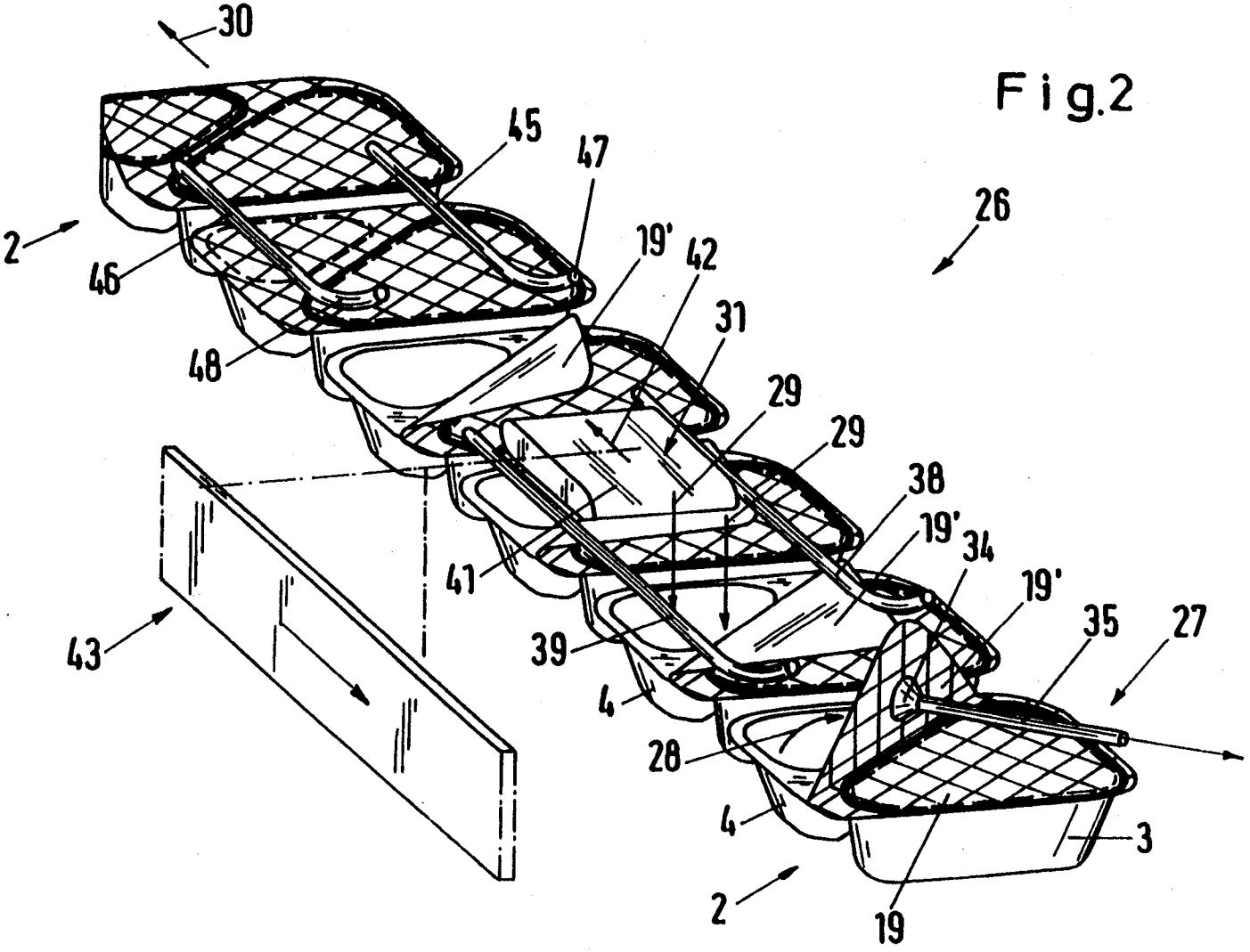
FIG. 2 is an enlarged perspective view of the apparatus of FIG. 1 with, in each case, the component parts for opening, filling and closing the second chamber of the two-chamber container.

In FIG. 2, an enlarged sectional representation illustrates the apparatus 1, in which component parts are disposed in the conveyor belt area 26 below the metering apparatus 25. With these component parts, the two-chamber containers, supplied consecutively in a forward feeding direction 30, can be uncovered in the region of chamber 4, filled, then covered once again and closed off by means of a second partial seal.

In an embodiment appropriate for this purpose, a lifting element 27, which brings the respective unsealed covering sheet area 19' of the two-chamber container 2 into an open position, is provided immediately behind the severing station 22. With this lifting element 27, the covering sheet area 19' can be raised and tilted in the direction of arrow 28 as shown in FIG. 9.

Figure 10:
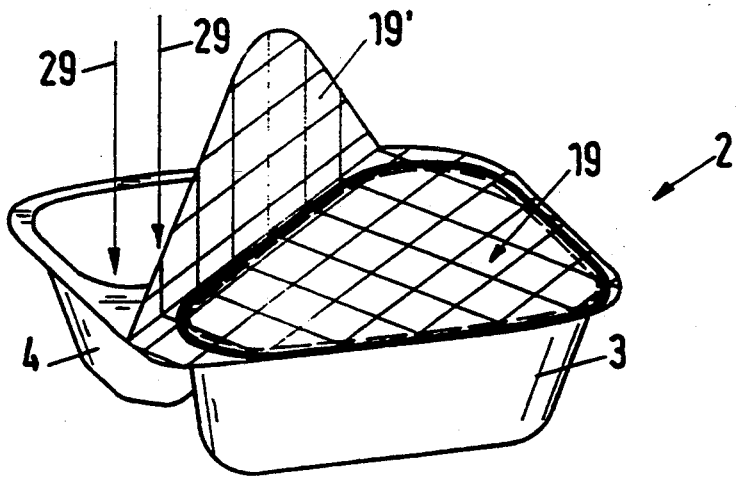
FIG. 10 is a perspective view of the filling of the second chamber of the two-chamber container.

After that, in a tilted position of the covering sheet area 10 illustrated in FIG. 10, the chamber 4 can be filled in a supplying direction 29 without additional aids, the entry of, for example, material containing dust-like structures without affecting the material in chamber 3 also being possible.

Figure 11:
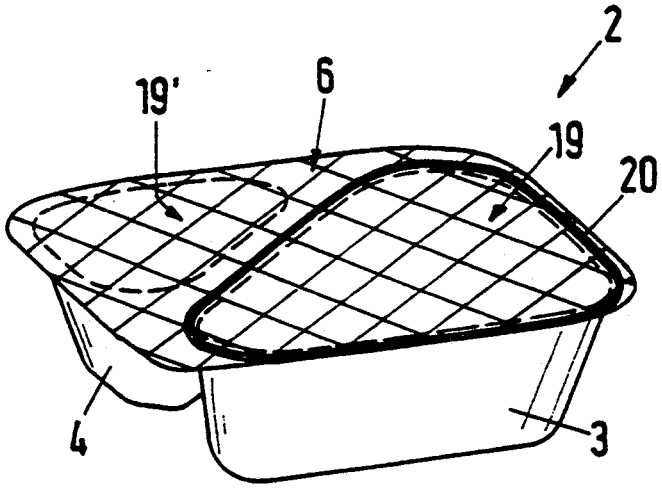
FIG. 11 is a perspective view of the two-chamber container with the covering sheet folded back in the region of the second chamber.

With two-chamber containers 2 in different filling phases as shown in FIG. 2, it is made clear that, after the chamber 4 is filled in the direction of arrow 29, the unsealed covering sheet area 19' now moves over a closing element 31 into a sealing position (FIG. 11) and, after that, the two-chamber container 2 can be carried to a sealing station 32 (FIG. 1) forming the second partial seal in such a manner, that a fully sealed two-chamber container 2 (FIG. 12) can be removed at the end of apparatus 1 by means of a transporting unit 33.

Figure 9:
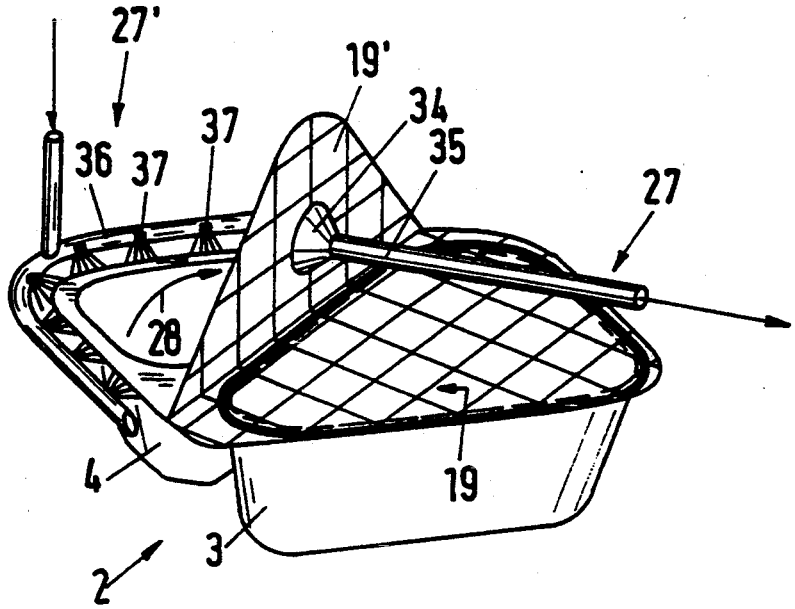
FIG. 9 is a perspective view of the two-chamber container with the covering sheet region over the second chamber in an open position.

In FIG. 9, an enlarged detailed representation illustrates two possible embodiments of the lifting element 27 or 27' acting on the covering sheet area 19'. This lifting element 27 can be formed from a suction nozzle 35 with a suction cup 34 as well as from an emitter 36 with several nozzles 37.

In FIG. 2, the use of the suction nozzle 35 is shown, which tilts up the covering sheet area 19' in the direction of the arrow by means of the suction cup 34. It is clear here that a guiding element, which is connected in series with the forward feeding equipment 30, overlaps the raised cover region 19' at least in areas and is formed from two guiding rails 38, 39, is provided in the region of the lifting element 27. With this guiding element, the elastically tilted covering sheet area 19' can be supported during the filling (in the direction of arrow 29) of chamber 4 in such a way, that the metering apparatus 25, having a metering element, can be used with the least space for the filling process.

It is advisable to provide the closing element 31, which is constructed as a sliding rail 41 between the end region of the two guide rails 38, 39 located in the forward feeding direction 30. This closing element 31 can be shifted in a direction of motion illustrated by arrow 42, so that the unsealed covering sheet area 19, after the two-chamber container 2 is filled, can be placed in the region of the second chamber 4 on the edge flange 20 flush with the edge.

Figure 3:
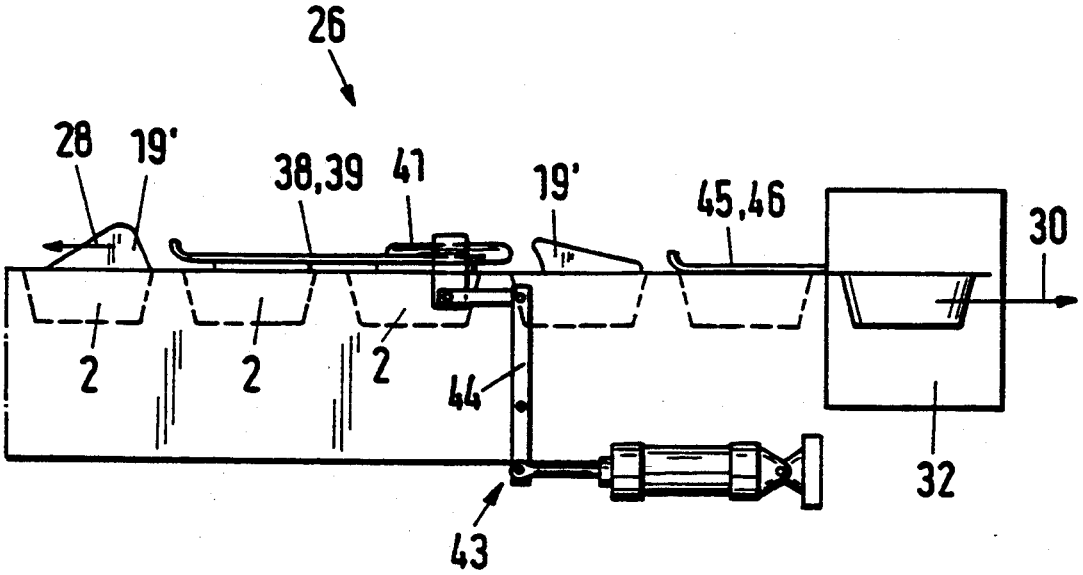
FIGS. 3 and 4 each are side views of the component parts of the apparatus of FIG. 2 in different phases of operation.
Figure 4:
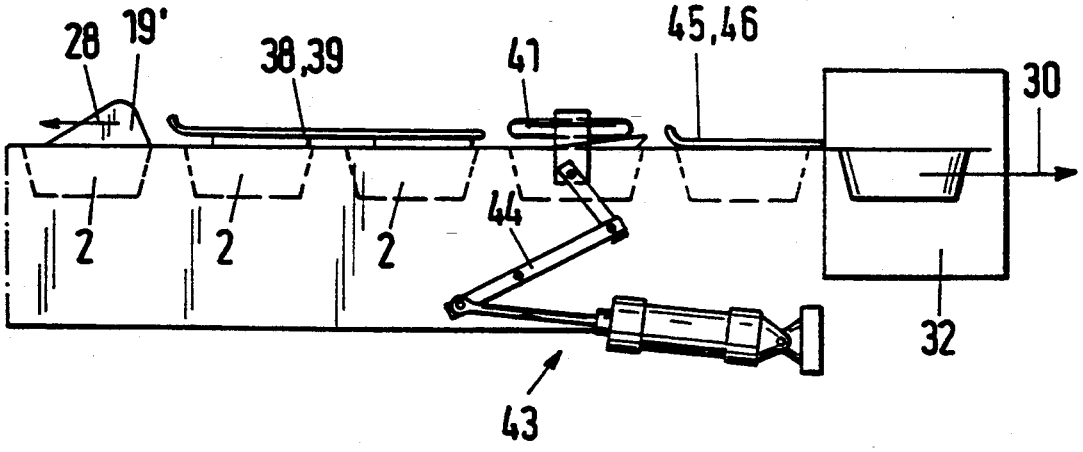

In FIGS. 3 and 4, different movement phases of a driving unit 43 for driving the sliding rail 41 are shown. In an appropriate embodiment, the sliding rail 41 is coupled with a timing rake 44 intended for the transport of the two-chamber containers 2 in such a manner, that the covering sheet area 19' behind the guide rails 38, 39 can be taken hold of from behind with the sliding rail 41, tilted into the covering position (FIG. 11, FIG. 2) and introduced in this position into the region of two parallel pressing rails 45, 46 (FIG. 4). With these pressing rails 45, 46 and their inlet curves 47, 48, guidance for the covering sheet area 19' can be achieved with little effort, so that this covering sheet area 19' remains in its covering position until the two-chamber container 2 enters the sealing station 32. It would also be conceivable to reshape the covering sheet material plastically in the area of its tilting plane in such a manner, that the covering sheet 6 remains in the closed position (FIG. 11) on the container 2 without spring-back, after which the second partial sealing takes place.

Figure 12:
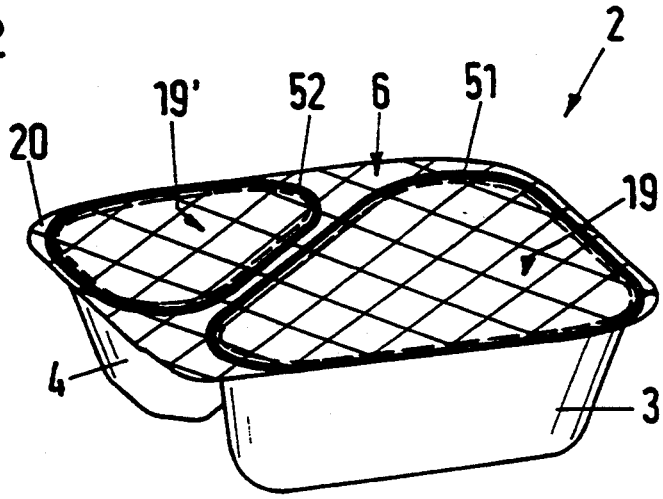
FIG. 12 is a perspective view of the fully sealed two-chamber container.

FIG. 12 is a detailed representation illustrating the two-chamber container 2 with a full seal, formed in the region of the covering sheet 6 after passing through the sealing station 32. In this closed position, the covering sheet 6 is connected by means of separate sealing seams 51, 52 with the sealing edge 20, which surround the chamber openings 3, 4. The connecting part between the two chamber openings 3, 4 is formed with a bridge width 53 accommodating the two sealing seams 51, 52 (FIG. 13), which run at least in areas parallel to the edges of the two covered chambers 3, 4.

The sealing seams 51, 52 are formed over the consecutive partial seals (FIG. 1) on the sealing edge 20 and adapted in their respective contours parallel to the edges of the different covering sheet areas 19, 19'.

In the region of the connecting part between the parallel sections of the sealing seams 51, 52 (FIG. 13), the container sheet 5 can be provided with a line of weakness 54, which is constructed as a perforation and divides the bridge width 53 into two partial areas of equal width and, when the two-chamber container 2 is used, forms the intended break line.

In the area of the sealing seams 51, 52, the sealing edge 20 can be provided at least near the chambers 3, 4 with sealing beads shaped as an elevation towards the sealing sheet 6, so that the seal, while retaining a reliable tightness, therewith has a connecting plane, which can be cooled readily during the closing process and opened more easily when the two-chamber container is used.

Figure 13:
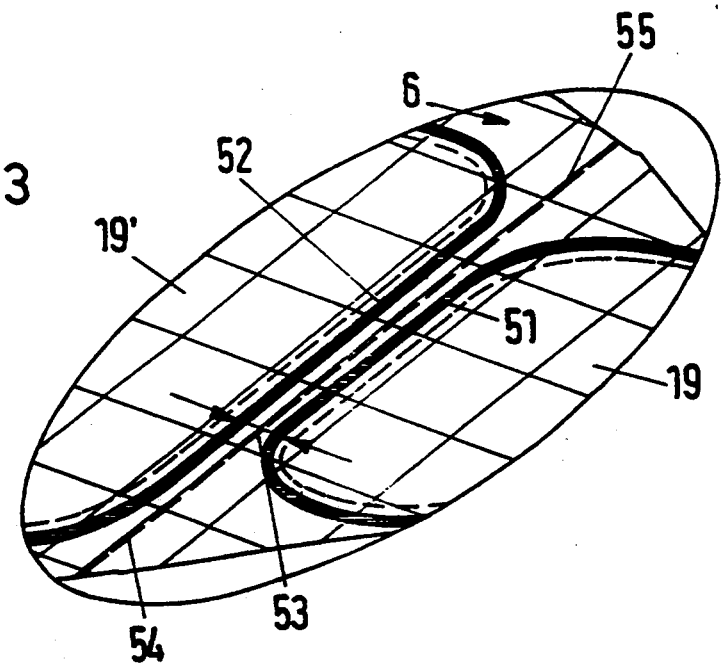
FIG. 13 is an enlarged sectional view of the two-chamber container completely sealed in the region between the two chambers.

The area of the covering sheet 6, lying on the connecting part in the sealing position, is furthermore provided with a folding-over line 55, between the two parallel sealing seams 51, 52 (FIG. 13). In the region of this folding-over line 55, a swiveling axis for the opening of the chamber 4 (FIG. 9), necessary while filling the two-chamber container 2 or for the subsequent covering, is formed and disadvantageous overloading of the first partial seal in the parallel region of the sealing seam 51 is avoided.

In the embodiment of the two-chamber container 2 shown, the connecting part, having the line of weakness 54, is aligned diagonally between the two chambers 3 and 4, while the basic shape of the two-chamber container 2 is essentially rectangular. However, the method and the apparatus for filling and closing the two-chamber container 2 is not limited to this shape of container.

What I claim is:

1. Apparatus for filling and sealing a two-chamber container comprising:

forming means for forming two-chamber containers in a container sheet, each of said two-chamber containers having a first chamber and a second chamber;

first filling means for filling said first chamber of each two-chamber container with a first filling material;

cover feeding means for feeding a cover sheet to a position overlying said two-chamber containers;

first sealing means for sealing said cover sheet to said container sheet at a peripheral portion of said first chamber to thereby seal said first material in said first chamber;

displacing means for displacing a displaceable position of said cover sheet which overlies said second chamber to a displaced portion to provide access to said second chamber for filling;

second filling means for filling said second chamber with a second filling material;

return means for returning said displaceable portion of said cover sheet from said displaced position to a position overlying said second chamber; and second sealing means for sealing said cover sheet to said container sheet at a peripheral portion of said second chamber to thereby seal said second material in said second chamber.

2. Apparatus according to claim 1 wherein said forming means comprises first sterile means operable to provide for forming said two-chamber containers under sterile conditions, said cover feeding means comprising second sterile means operable to provide for feeding said cover sheet under sterile conditions, said first filling means comprising third sterile means operable to provide for filling said first chamber by said first filling means under sterile conditions.

3. Apparatus according to claim 1 further comprising severing means for severing said container sheet and cover sheet into individual two-chamber containers after said first sealing means has sealed said cover sheet to said container sheet and prior to said displacing means displacing said displaceable portion of said cover to said displaced position.

4. Apparatus according to claim 1 wherein said displacing means comprises a suction means which is operable to adhere to said displaceable portion of said cover by subjecting said suction means to a pressure less than atmospheric pressure.

5. Apparatus according to claim 1 wherein said displacing means is pivotal to effect displacing of said displaceable portion of said cover sheet from said position overlying said second chamber to said displaced position.

6. Apparatus according to claim 1 wherein said displacing means comprises an emitter conduit having a plurality of discharge nozzles discharging compressed air juxtaposed to said displaceable portion of said cover sheet.

7. Apparatus according to claim 1 wherein said displacing means comprises guide rails overlying said cover sheet and operable to retain said displaceable portion of said cover in said displaced position.

8. Apparatus according to claim 1 wherein said return means comprises a slidable member operable to engage said displaceable portion of said cover sheet and return said displaceable portion from its displaced position to a position overlying said second chamber.

9. Apparatus according to claim 3 further comprising advancing means for advancing said two-chamber containers in an advancing direction from said severing means to a discharge station, said return means being operable to slide said slidable member in said advancing direction.

10. Apparatus according to claim 8 wherein said slidable member is slidable between a forward position and a return position, said slidable member when sliding from said return position to said forward position effecting displacement of said displaceable portion of said cover from said displaceable position to said position overlying said second chamber, said slidable member being at one elevation when at said forward position and at another elevation when at said return position, said one elevation being a lower elevation than said other elevation.

* * * * *